US007406929B2

(12) United States Patent
Hassdenteufel et al.

(10) Patent No.: US 7,406,929 B2
(45) Date of Patent: Aug. 5, 2008

(54) COOLING CIRCUIT OF AN INTERNAL COMBUSTION ENGINE COMPRISING A LOW-TEMPERATURE RADIATOR

(75) Inventors: Klaus Hassdenteufel, Gerlingen (DE); Stefan Rogg, Stuttgart (DE)

(73) Assignee: BEHR GmbH & Co. KG, Stuttgart (DE)

( * ) Notice: Subject to any disclaimer, the term of this patent is extended or adjusted under 35 U.S.C. 154(b) by 27 days.

(21) Appl. No.: 10/542,371

(22) PCT Filed: Jan. 14, 2004

(86) PCT No.: PCT/EP2004/000202

§ 371 (c)(1),
(2), (4) Date: May 10, 2006

(87) PCT Pub. No.: WO2004/063543

PCT Pub. Date: Jul. 29, 2004

(65) Prior Publication Data

US 2006/0254538 A1 Nov. 16, 2006

(30) Foreign Application Priority Data

Jan. 16, 2003 (DE) ..... 103 01 564

(51) Int. Cl.
*F01P 7/16* (2006.01)
*F28D 1/00* (2006.01)

(52) U.S. Cl. ..... 123/41.1; 165/148

(58) Field of Classification Search ..... 123/41.41, 123/41.29, 41.31, 41.33, 41.1, 196 AB; 165/148
See application file for complete search history.

(56) References Cited

U.S. PATENT DOCUMENTS

| | | | |
|---|---|---|---|
| 2,188,172 A | 1/1940 | Brehob | |
| 2,670,933 A | 3/1954 | Bay | |
| 4,061,187 A | 12/1977 | Rajasekaran et al. | |
| 4,180,032 A | 12/1979 | Plegat | |
| 5,794,575 A | 8/1998 | Sonnemann et al. | |
| 6,173,766 B1 * | 1/2001 | Nakamura et al. | 165/176 |
| 6,196,168 B1 | 3/2001 | Eckerskorn et al. | |

FOREIGN PATENT DOCUMENTS

| | | |
|---|---|---|
| DD | 1584 15 | 1/1983 |
| DE | 766 237 | 4/1952 |
| DE | 35 17 567 A1 | 12/1985 |
| DE | 40 32 701 A1 | 6/1992 |
| DE | 195 13 248 A1 | 10/1996 |
| DE | 196 37 817 A1 | 3/1998 |
| DE | 197 11 259 A1 | 10/1998 |
| DE | 199 26 052 A1 | 12/2000 |

(Continued)

*Primary Examiner*—Stephen K. Cronin
*Assistant Examiner*—Hyder Ali
(74) *Attorney, Agent, or Firm*—Foley & Lardner LLP

(57) ABSTRACT

The invention relates to a cooling circuit of an internal combustion engine of motor vehicles, comprising a main cooling circuit that encompasses a section located upstream of the radiator, a main radiator, a radiator return path, a coolant pump, a main thermostat, and a bypass or short circuit which is disposed between the main thermostat and the coolant pump. Said cooling circuit further comprises a low-temperature circuit encompassing a low-temperature radiator, a low-temperature radiator return path, a valve unit, and an additional heat exchanger.

18 Claims, 6 Drawing Sheets

FOREIGN PATENT DOCUMENTS

Figure 1:
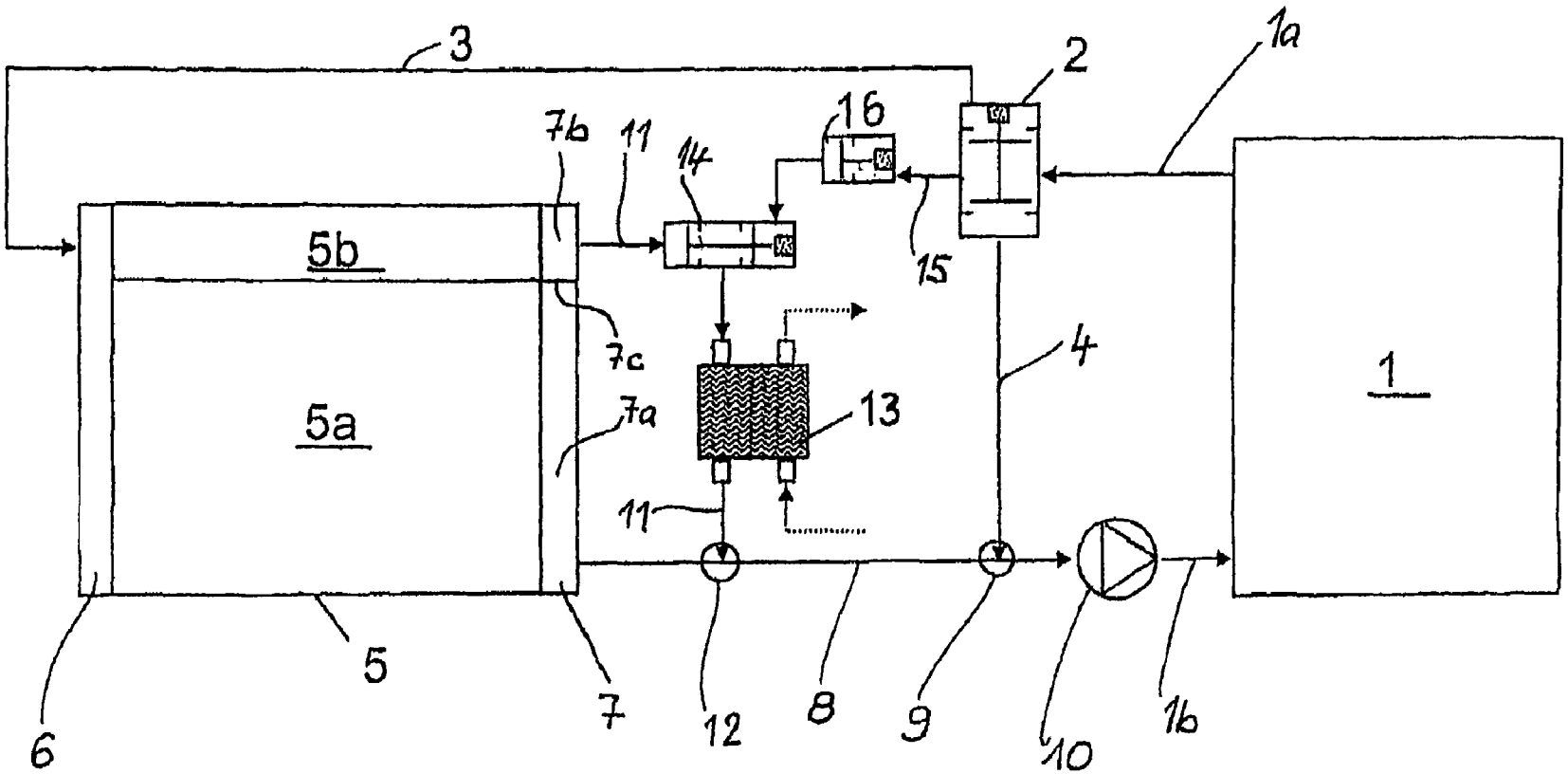

| | | | |
|---|---|---|---|
| EP | 0 861 368 | B1 | 9/1998 |
| FR | 2 341 041 | | 9/1977 |
| FR | 2 682 160 | | 4/1993 |
| FR | 2 838 477 | A1 | 10/2003 |
| GB | 2 099 981 | A | 12/1982 |
| JP | 27 17520 | A1 | 11/1977 |
| WO | WO 02/48516 | A1 | 6/2002 |

* cited by examiner

COOLING CIRCUIT OF AN INTERNAL COMBUSTION ENGINE COMPRISING A LOW-TEMPERATURE RADIATOR

The invention relates to a cooling circuit of an internal combustion engine of motor vehicles as claimed in the preamble of patent claim 1, and to a coolant radiator of a cooling circuit of an internal combustion engine as claimed in the preamble of patent claim 11—both known from DE-A 196 37 817.

DE-A 196 37 817 and the corresponding EP-B 861 368 have disclosed a cooling circuit of an internal combustion engine with a low-temperature radiator which, on the coolant side, is connected in series with a main radiator. A main stream of coolant, from which a partial stream is branched off in an outlet-end collecting box and conveyed through the low-temperature radiator in the opposite direction to the main stream, flows through the main radiator. The branching of the partial stream is brought about by a dividing wall which is arranged in an inlet box of the coolant radiator. The inlet box thus has two chambers, specifically a main chamber for the main coolant stream, and a secondary chamber for the emerging partial stream which flows through the entire radiator twice and is thus cooled to a greater degree. The partial stream which emerges from the secondary chamber is used to cool gear oil, and if necessary is mixed with coolant from an equalizing vessel. The two partial streams are mixed by means of a valve unit from which the conditioned coolant is fed to the gear oil radiator for cooling or preheating. The cooling circuit also contains a main or motor thermostat which is arranged in the radiator return flow section, i.e. on the coolant side downstream of the main radiator. The known cooling circuit and the known coolant radiator have various disadvantages: firstly the connection in series in a radiator block results in a reduced thermodynamic effect of the entire radiator. The average temperature difference between the coolant and the cooling air is lower in the low-temperature radiator than in the main radiator, and the average temperature difference between the coolant and cooling air for the entire unit is thus lower. Furthermore, with this unit thermal stresses occur because the average coolant temperature in the main radiator is higher than that in the low-temperature radiator. The thermal stresses owing to different expansion rates of the coolant pipes adversely affect the pipe base connections, which can give rise to leakages. Finally, the hydraulic adjustment in the entire cooling circuit is associated with difficulties since the partial stream of coolant through the low-temperature radiator is dependent on the pressure losses of the return flows of the main stream and of the partial stream. In order to bring about a sufficient quantity of coolant through the coolant radiator and thus also through the downstream gear oil radiator a specific drop in pressure in the return flow of the main stream is necessary, which occurs here as a result of the arrangement of the main thermostat in the radiator return flow section. The restriction to circuits with a main thermostat at the radiator outlet end is disadvantageous since this precludes general application.

Another design of a coolant radiator in conjunction with an additional heat exchanger, in particular a gear oil radiator, has been disclosed by DE-A 199 26 052. The gear oil radiator is attached to the output-end collecting box of the radiator and a partial stream of the coolant flows through it, this being brought about by a dividing wall or throttle point which is arranged in the outlet-end collecting box between the coolant ports for the gear oil radiator. A pressure gradient which results from this forces the partial stream of coolant through the gear oil radiator. A disadvantage with this arrangement is that the gear oil radiator is cut off from the coolant stream while the engine is warming up, i.e. when the main thermostat is closed, with the result that it is possible neither to heat the gear oil when the engine is warming up nor to cool it in the winter. Furthermore, it is also impossible to regulate the quantity of coolant.

A further simplified form of gear oil cooling is disclosed by the arrangement of a gear oil radiator in the outlet water box of a coolant radiator, for example by DE-A 197 11 259. Here too, it is also impossible to regulate the quantity of coolant and the gear oil radiator is cut off from the coolant stream during the warming up phase of the engine.

The object of the present invention is to improve the heating and/or cooling of an additional fluid with the cooling circuit or coolant radiator mentioned at the beginning in that sufficient cooling is ensured even in thermally critical operating states, and a sufficient supply of coolant is also ensured when the engine is warming up, and at the same time the coolant radiator has a relatively high level of thermodynamic efficiency and permits hydraulic connection with low pressure losses.

Means of achieving this object emerge from the features of patent claims 1 and 11. Advantageous embodiments of the invention emerge from the respective subclaims.

The parallel connection of the main stream of coolant and partial stream in the low-temperature region according to the invention brings about a large drop in the temperature of the coolant without precooling, i.e. owing to a lower coolant flow speed. The invention can be applied to cooling circuits in which the main thermostat is arranged either in the section located upstream of the radiator or in the radiator return flow section. The division of the partial stream from the main stream is advantageously effected by a dividing wall which is arranged in the output-end collecting box or an "unsealed dividing wall", i.e. a dividing wall which is provided with a throttle point. Likewise, a valve can be arranged in the dividing wall in order to influence the quantity of coolant in the main stream and in the partial stream. The outlet of the low-temperature radiator is advantageously connected to the main thermostat, the bypass or the section upstream of the radiator in order to supply the gear oil radiator with a sufficient quantity of coolant even in the warming up phase of the engine, i.e. when the main thermostat is closed. A mixing thermostat which regulates the mixing temperature from the return flow section of the low-temperature radiator and from the engine-end inflow section for the gear oil radiator inlet is advantageously inserted into the return flow section of the low-temperature radiator here. An opening thermostat or warming up thermostat which prevents cold coolant from being supplied is advantageously arranged in the engine-end inflow section for the mixing thermostat. As a result, excessive gear oil cooling and excessive gear oil heating can be prevented while the engine is warming up. This reduces the consumption of fuel and the emissions, improves the heating comfort and lengthens the service life of the gear oil.

In the coolant radiator according to the invention, the main region and the low-temperature region are composed of a common pipe/rib block through which there is a parallel flow, i.e. there is no precooling of the partial stream. This means a higher level of thermodynamic efficiency for the entire radiator since the average temperature difference between the coolant and cooling air is increased. On the other hand, the average difference in temperature in the pipes of the main region and those of the low-temperature region is lower so that no damaging stresses arise for the radiator block. This is the case even if there is a flow through the low-temperature part a second time in the opposite direction as a result of what is referred to as deflection at depth. As a result, the outlet temperature of the partial stream can be reduced even further.

Figure 2:
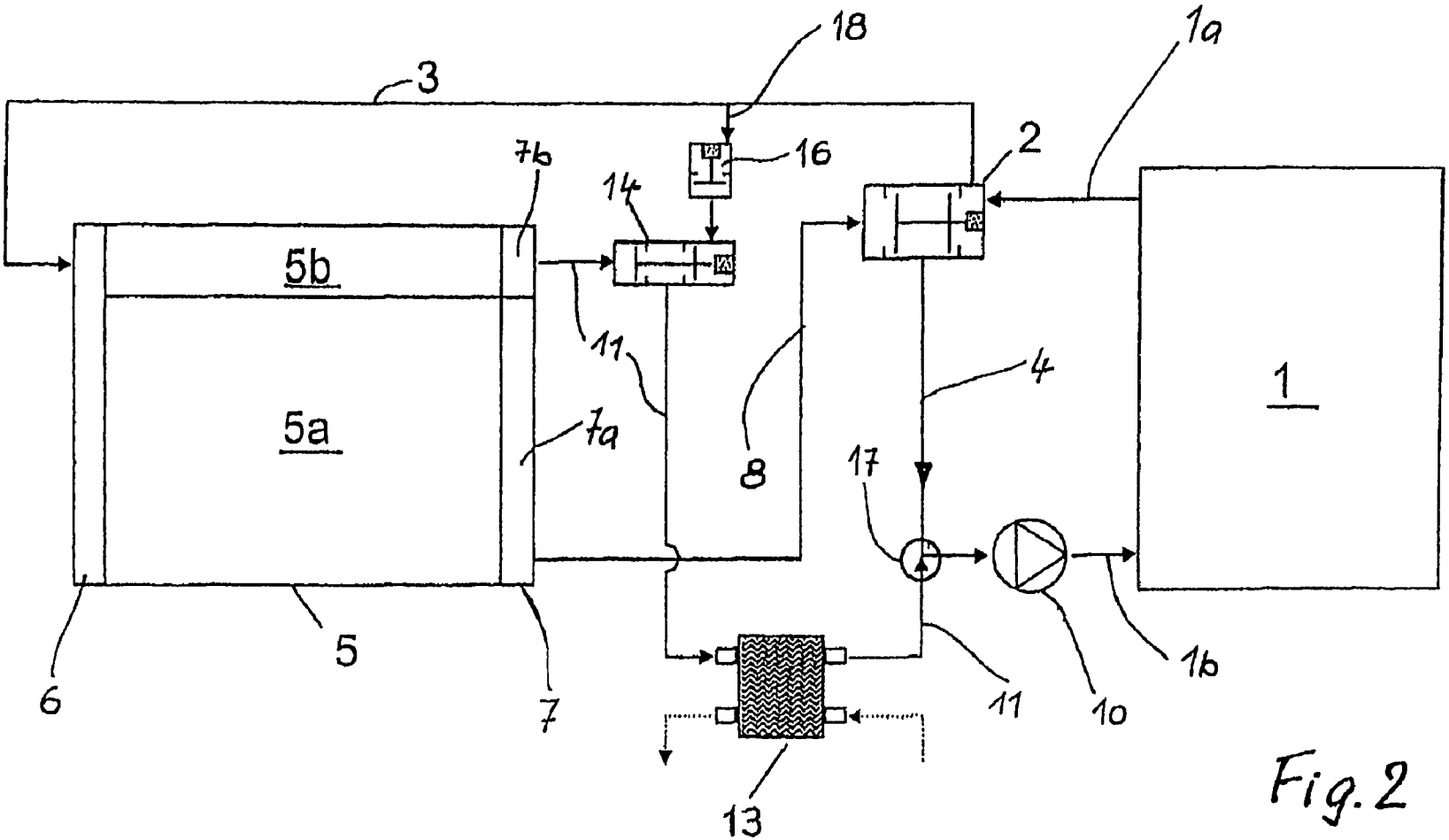
Figure 3:
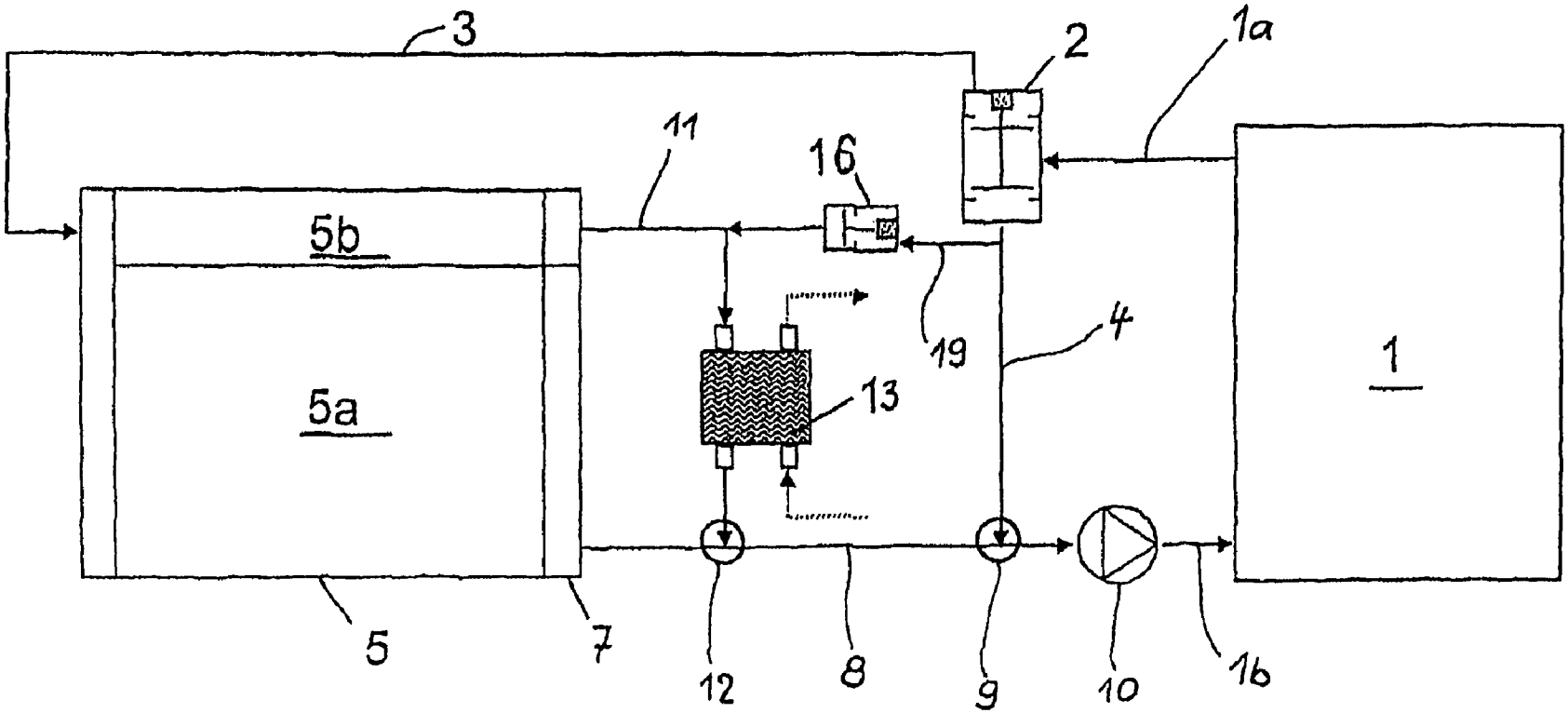
Figure 4:
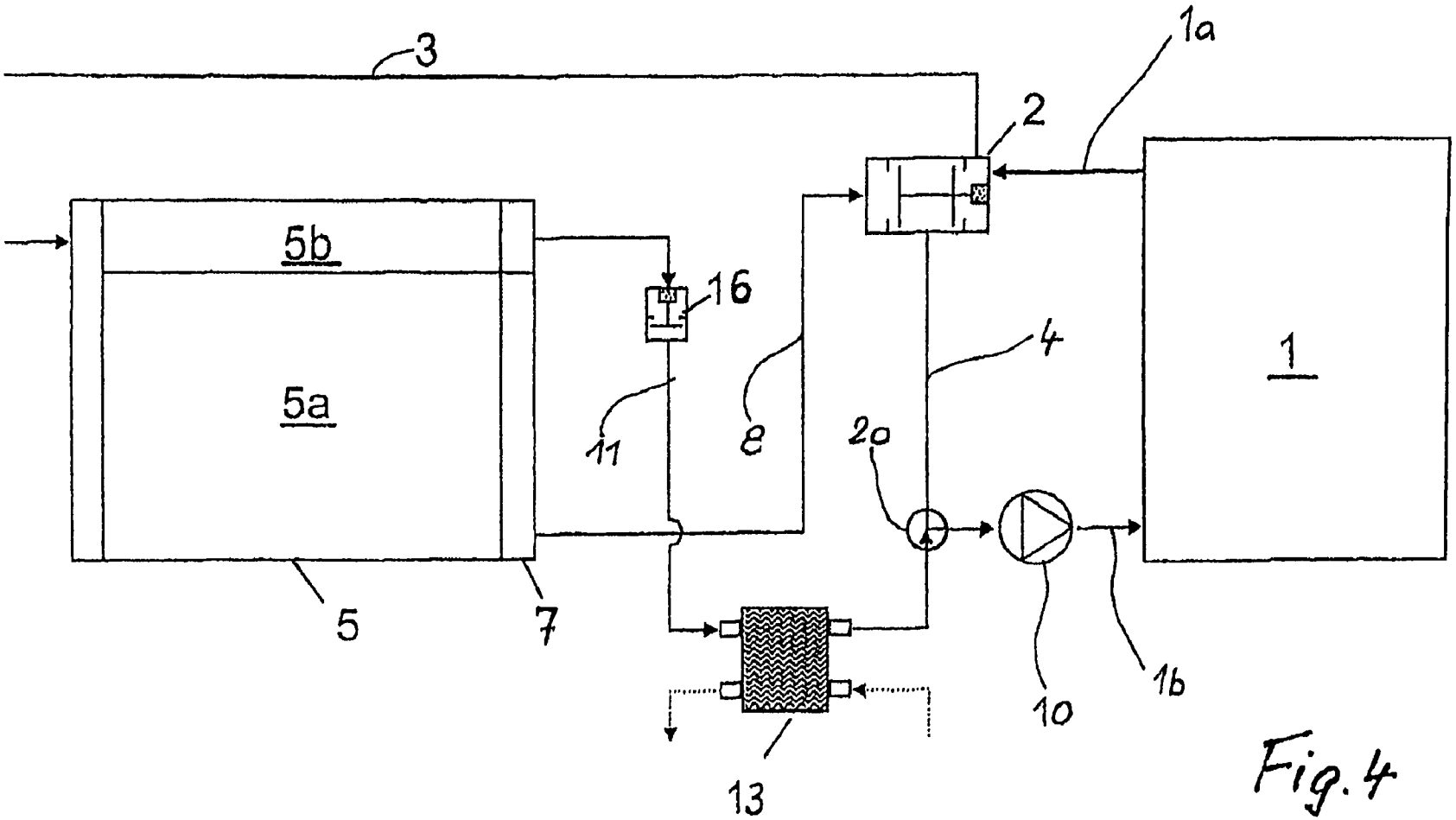
Figure 5:
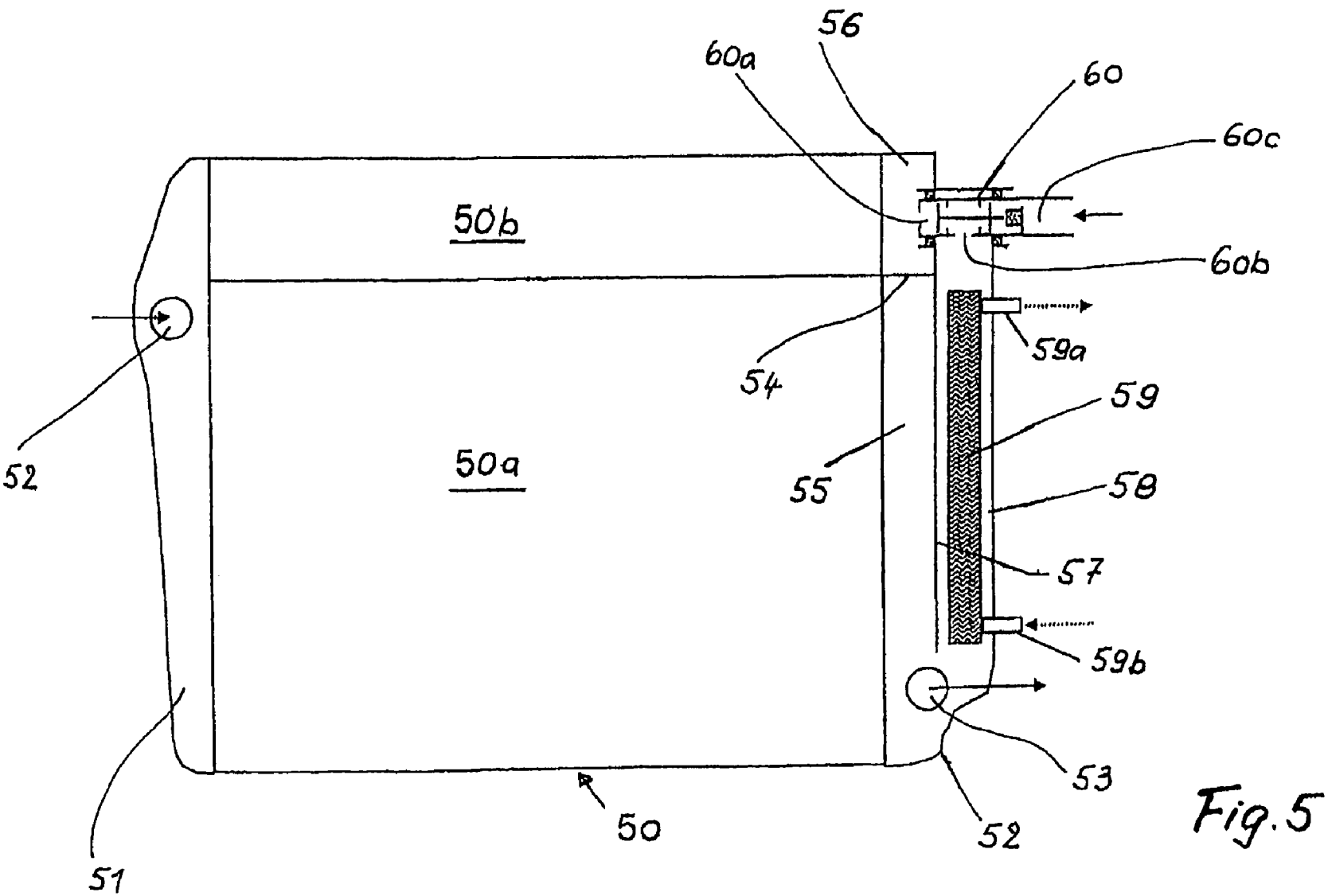
Figure 6:
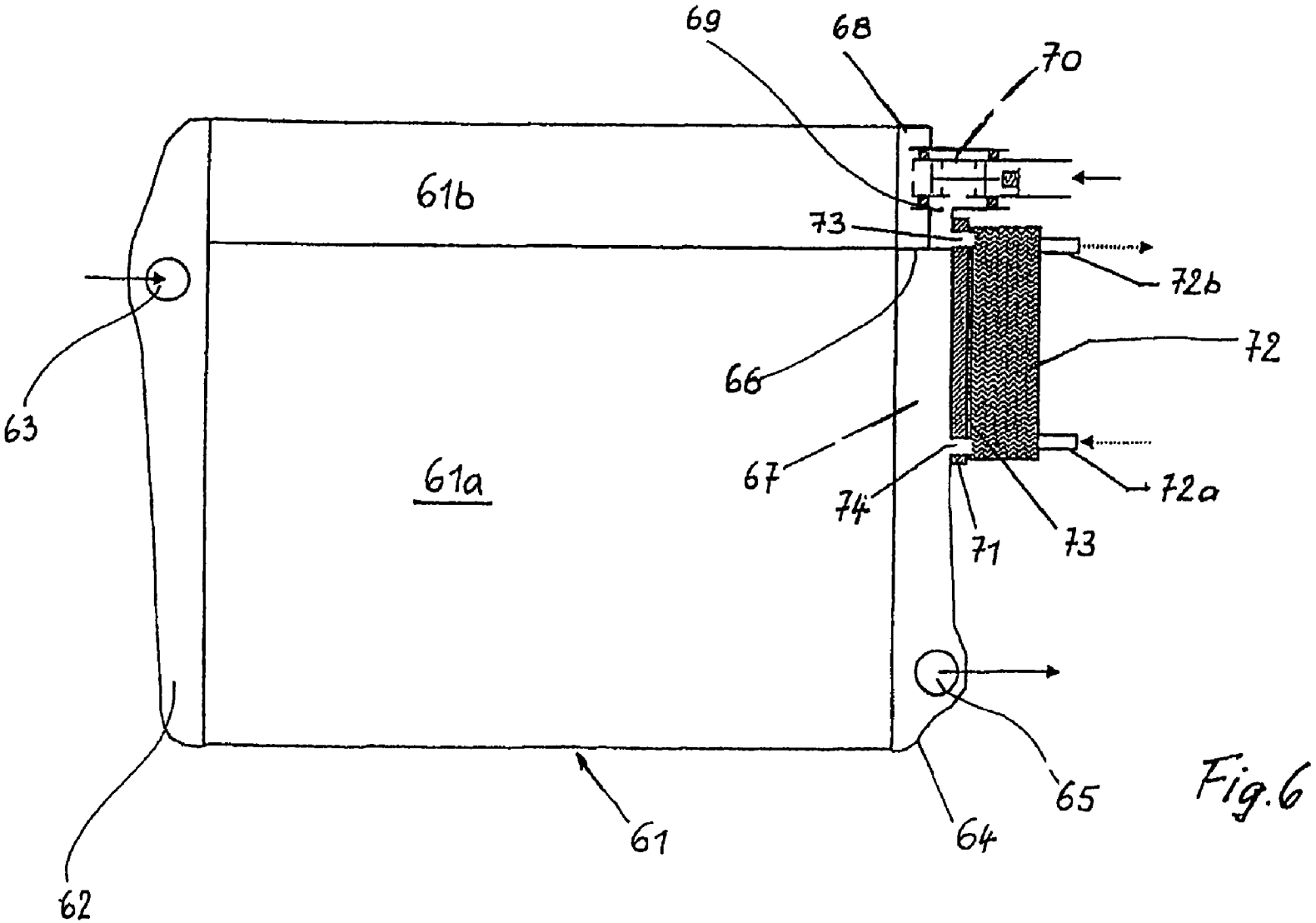

Exemplary embodiments of the invention are illustrated in the drawings and will be described in more detail below. In said drawings:

FIG. 1 shows a first cooling circuit with a radiator-inlet-end main thermostat, FIG. 2 shows a second circuit with a radiator-outlet-end main thermostat, FIG. 3 shows a third, simplified circuit with a radiator-inlet-end main thermostat, FIG. 4 shows a fourth, simplified circuit with radiator-outlet-end main thermostat, FIG. 5 shows a coolant radiator with an integrated gear oil radiator, and FIG. 6 shows a coolant radiator with an outlet-end collecting box to which a gear oil radiator is attached.

FIG. 1 shows a cooling circuit of an internal combustion engine 1 of a motor vehicle (not illustrated). Heated coolant emerges from an engine return flow section 1*a* into a main thermostat 2 to which a section 3 located upstream of the radiator and a short circuit or bypass 4 are connected. The section 3 arranged upstream of the radiator opens into a radiator 5 with an inlet box 6 and an outlet-end collecting box 7. The radiator 5 has a main region 5*a* and a low-temperature region 5*b* through which a main stream of coolant and a secondary stream or partial stream of coolant flow parallel to one another. For this purpose, the outlet-end collecting box 7 has two chambers 7*a*, 7*b* which are divided from one another by a dividing wall 7*c*. The inlet-end collecting box 6 is, on the other hand, uninterrupted, i.e. without a dividing wall. The main stream of coolant passes from the main chamber 7*a* into the radiator return flow section 8, joins the bypass 4 at the junction 9 and is conveyed back into the internal combustion engine 1 via the section 1*b* located upstream of the engine by means of a coolant pump 10. A low-temperature radiator return flow section 11 adjoins the low-temperature region 5*b* or the outlet-end secondary chamber 7*b* and feeds into the radiator return flow section 8 at the junction 12. A gear oil radiator 13 is connected into the low-temperature radiator return flow section 11. Between the secondary chamber 7*b* and the gear oil radiator 13, a mixing thermostat 14 is connected into the return flow section 11 and is connected to the main thermostat 2 by means of a branch line 15, into which an opening or warming up thermostat 16 is connected.

The cooling circuit functions as follows: when the internal combustion engine 1 is warm the main thermostat is opened completely to the section 3 located upstream of the radiator and closed to the bypass line 4, i.e. the coolant flows into the radiator 5 where it flows in parallel through both regions, the main region 5*a* and the low-temperature region 5*b*. The main stream passes back into the internal combustion engine 1 via the radiator return flow section 8 and the coolant pump 10. The partial stream which is cooled in the low-temperature region 5*b* passes via the return flow section 11 into the mixing thermostat 9 where, where necessary, warm coolant from the engine outlet 1*a* is added to it via the branch line 15, in order to regulate the cooling of the gear oil.

When the internal combustion engine is cold, i.e. at the start of the warming up phase, the main thermostat 2 is closed to the section 3 located upstream of the radiator and fully opened to the bypass line 4. Coolant does not flow through the radiator 5, but instead flows to the engine inlet 1*b* through the bypass line 4. The mixing thermostat 14 and the downstream gear oil radiator 13 thus receive no cold coolant. Instead, the mixing thermostat 14 receives only warm coolant from the engine outlet 1*a*. Since the coolant at the engine outlet 1*a* has not yet reached the operating temperature in this operating state, there is ample possibility of cooling the gear oil. At the start of the engine warming up phase the situation occurs in which the gear oil is colder than the coolant. The gear oil is then heated in the gear oil radiator 13 by the stream of coolant. It is appropriate to heat the gear oil within certain limits since as a result the gear oil quickly reaches the operating temperature and the friction losses in the transmission are reduced. However, it is advantageous if the heating of the gear oil is not started until after a certain time period after the start of the engine warming up phase in order to limit the heat loss of the engine cooling circuit. The inflow of warm coolant from the engine outlet 1*a* to the mixing thermostat 14 and to the downstream gear oil radiator 13 can be prevented by the warming up thermostat 16. This does not open until the coolant at the engine outlet 1*a* has reached a certain temperature.

If the main thermostat operates in the regulated range, it is partially opened to the section 3 located upstream of the radiator and to the bypass line 4. The mixing thermostat 14 is then supplied with cold coolant from the low-temperature region 5*b* and with warm coolant from the engine outlet 1*a*, which are mixed together to obtain the coolant temperature which is suitable for conditioning the temperature of the gear oil.

FIG. 2 shows a variant of the first cooling circuit according to FIG. 1, with identical reference symbols being used for identical parts. In contrast to the cooling circuit according to FIG. 1, the main thermostat 2 is arranged in the return flow section 8 of the coolant radiator 5 here. When the internal combustion engine 1 is warm and the main thermostat 2 is fully opened, the coolant flows via the section 3 located upstream of the radiator to the radiator 5, through which it flows in parallel in a main stream and a partial stream. The partial stream enters the return flow line 11 via the secondary chamber 7*b*, the mixing thermostat 14 and the gear oil radiator 13 being connected into said return flow line 11. At the junction 17 the return flow section 11 feeds into the bypass line 4 and the section located upstream of the coolant pump 10. When necessary, warm coolant from the engine outlet 1*a* or the section 3 located upstream of the radiator is added to the mixture in the mixing thermostat 14, specifically via a branch line 18 into which the opening thermostat or warming up thermostat 16 is connected.

If the main thermostat 2 is closed to the radiator return flow section 8 and opened to the engine outlet 1*a*, coolant does not flow through the main part 5*a* of the radiator 5. Instead, the main stream of coolant is fed directly to the coolant pump 10 via the short circuit 4. This state occurs during the warming up of the engine or at least at certain times in the winter operating mode. Depending on the position of the mixing thermostat 14, a partial stream of coolant can also pass through the low-temperature part 5*b* in this case also. Cold coolant from the low-temperature part 5*b* and warm coolant from the engine outlet 1*a* or from the section located upstream of the radiator is then present at the mixing thermostat 14 via the branch line 18 so that the temperature of the coolant which flows into the gear oil radiator 13 can be regulated by means of the mixing thermostat 14.

At the start of the engine warming up phase the situation occurs in which the gear oil is colder than the coolant. The gear oil is then heated by the coolant stream in the gear oil radiator 13. In order to ensure that the gear oil is not heated until after a certain time period after the start of the warming up of the engine, the inflow of the warm coolant from the engine outlet 1*a* or the section 3 located upstream of the radiator to the mixing thermostat 14 can be prevented by the warming up thermostat 16. The warming up thermostat 16 does not open until the coolant at the engine outlet 1*a* or in the section 3 located upstream of the radiator has reached a certain temperature. The flow through the low-temperature part 5*b* would also constitute a heat loss for the coolant circuit. This is prevented in this case by the mixing thermostat 14 being closed to the low-temperature part 5*b* because the coolant temperature at the outlet of the low-temperature part 5*b* is significantly below the target temperature for the outlet of the mixing thermostat 14.

If the main thermostat 2 operates in the regulated range, it is partially opened to the radiator return flow section 8 and to the engine outlet 1*a*. In this case, the mixing thermostat 14 is also supplied with cold coolant from the low-temperature part 5*b* and with warm coolant from the engine outlet 1*a* or from the section 3 located upstream of the radiator, from which the coolant temperature which is suitable for conditioning the temperature of the gear oil is mixed.

With respect to the cooling circuits according to FIGS. 1 and 2 it is to be noted that the mixing thermostat 14 may be an expansion material thermostat, a characteristic diagram thermostat or a regulating valve unit which is activated by extraneous energy. For the mixing thermostat 14, the guide variable of the regulating process may be the temperature of the hot coolant from the engine outlet 1*a* or from the section 3 located upstream of the radiator, the temperature of the coolant at the outlet of the mixing thermostat 14 or the temperature of the coolant at the outlet of the gear oil radiator 13. The warming up thermostat 16 may optionally also be arranged between the mixing thermostat 14 and gear oil radiator 13 or, in the case of the main thermostat 2 being arranged at the radiator inlet, between the engine outlet 1*a* and the section 3 located upstream of the radiator. In the latter case, the warm coolant is fed to the mixing thermostat 14 from the section 3 located upstream of the radiator.

The cooling circuits with gear oil radiator 13 according to FIGS. 1 and 2 may be simplified and thus optimized in terms of cost by dispensing with the mixing thermostat 14 and in each case using just one warming up thermostat 16. Such circuits are described below.

FIG. 3 shows a simplified cooling circuit in which identical reference symbols are used again for identical parts. The main thermostat 2 is arranged in the section 3 located upstream of the radiator. The gear oil radiator 13 is arranged in the return flow section 11 of the low-temperature region 5*b*. Coolant is fed into the return flow section 11 via a branch line 19 from the bypass 4 and via the warming up thermostat 16.

If the main thermostat 2 is fully opened to the section 3 located upstream of the radiator and closed to the bypass line 4, the coolant flows into the coolant radiator 5. The cooled partial stream of coolant flows from the outlet of the low-temperature region 5*b* into the gear oil radiator 13. The return flow section 11 then feeds into the radiator return flow section 8 at the junction 12.

If the main thermostat 2 is closed to the section 3 located upstream of the radiator and fully opened to the bypass line 4, coolant does not flow through the radiator 5. Instead, the main flow of coolant is guided directly to the coolant pump 10 via the bypass line 4. This state occurs during the warming up of the engine and at least some of the time in the winter operating mode. In this case, no cold coolant is fed to the gear oil radiator 13. Warm coolant passes from the engine outlet 1*a* via the branch 19 from the bypass line 4 to the warming up thermostat 16 and from there to the inlet of the gear oil radiator 13. Since the coolant at the engine outlet 1*a* has not yet reached the operating temperature in this state, there is sufficient possibility to cool the gear oil. At the start of the warming up of the engine the situation occurs in which the gear oil is colder than the coolant. The gear oil is then heated by the stream of coolant in the gear oil radiator 13. It is advantageous here to permit the gear oil to heat up only after a certain time period after the warming up of the engine. This is ensured by the fact that the warming up thermostat 16 does not open until the coolant at the engine outlet 1*a* or in the bypass line 4 has reached a specific temperature.

If the main thermostat 2 operates in the regulated range, it is partially opened to the section 3 located upstream of the radiator and to the bypass line 4. The gear oil radiator 13 is then supplied with a mixture of cold coolant from the low-temperature region 5*b* and warm coolant from the engine outlet 1*a*.

FIG. 4 shows a simplified cooling circuit in which identical reference symbols are again used for identical components. The main thermostat 2 is arranged here in the return flow section 8 of the radiator. The warming up thermostat 16 and the gear oil radiator 13 are arranged in the return flow section 11 of the low-temperature region 5*b* or of the low-temperature radiator 5*b*. After the return flow 11 emerges from the gear oil radiator 13 at the junction 20 it is combined with the short circuit line 4 and is fed from there to the coolant pump 10.

If the main thermostat 2 is closed to the radiator return flow section 8 and fully opened to the engine outlet 1*a*, coolant does not flow through the main region 5*a* of the radiator 5. Instead, the main stream of coolant is guided directly to the coolant pump 10 via the short circuit 4. This state occurs during warming up and at least partially in the winter operating mode. Depending on the position of the opening or warming up thermostat 10 it is also possible in this case for a partial stream of coolant to pass through the low-temperature radiator 5*b*. Cold coolant flows to the gear oil radiator 13 from the opening thermostat 16. The opening thermostat 16 ensures here that the coolant is at a minimum temperature so that excessive cooling of the gear oil is prevented. At the start of the warming up of the engine the situation occurs in which the gear oil is colder than the coolant. The gear oil is then heated in the gear oil radiator 13 by the stream of coolant. It is advantageous to permit the gear oil to heat up only after a certain time period after the start of the warming up of the engine. This is achieved in that the warming up thermostat 16 is not opened until the coolant at the outlet of the low-temperature radiator 5*b* has reached a specific temperature.

If the main thermostat 2 operates in the regulated range, it is partially opened to the radiator return flow section 8 and to the engine outlet 1*a*. In this case also, the gear oil radiator 13 is also supplied with cold coolant from the low-temperature part 5*b*, but said cold coolant has a minimum temperature owing to the warming up thermostat 16.

With respect to the cooling circuits described above in accordance with FIGS. 1 to 4 it is also to be noted that they are illustrated in a simplified form insofar as, for example, an equalizing vessel and a heating circuit are not illustrated. Warm coolant can also be fed to the mixing thermostat and the gear oil radiator from the equalizing vessel. Moreover, in the cooling circuits mentioned above a gear oil radiator was selected as the supplementary heat exchanger only by way of example. Said heat exchanger can also be replaced by some other load, i.e. another heat exchanger or an electronic component which is to be cooled. The opening thermostat 16 can, like the mixing thermostat 9, be an expansion material thermostat, a characteristic diagram thermostat or a valve unit which is activated by extraneous energy. This also applies to the main thermostat 2.

Finally, the warming up thermostat 16 can also be arranged between the gear oil radiator 13 and the junction 12, 17, 20. The opening time of the warming up thermostat 16 then also depends significantly on the gear oil temperature. At low temperatures of the gear oil and of the coolant the warming up thermostat 16 is closed and the gear oil is neither heated nor cooled. At a high temperature of the coolant and a low temperature of the gear oil, the warming up thermostat 16 is opened and the gear oil is heated. At a low or high temperature of the coolant and a high temperature of the gear oil, the warming up thermostat 16 is opened and the gear oil is cooled.

FIG. 5 shows a coolant radiator 50 which corresponds to the coolant radiator 5 illustrated in FIG. 1, with the gear oil radiator 13 illustrated there and the mixing thermostat 14 being combined with the coolant radiator to form one unit 50. The coolant radiator 50 has a uniform pipe/rib block composed of a main region 50*a* and a secondary or partial region 50*b*. The pipes (not illustrated) of this pipe/rib block 50*a*, 50*b* open on the one hand into a coolant inlet box 51 with a coolant inlet 52 and into an outlet-end collecting box 52 with a coolant outlet 53. The collecting box 52 is divided by a dividing wall 54 into a main chamber 55, which opens into the outlet 53, and a secondary chamber 56. The dividing wall 54 is sealed in the illustrated exemplary embodiment, but it can also have a throttle point (not illustrated) or a valve so that both chambers 55, 56 can communicate with one another. The main chamber 55 is divided by a longitudinal dividing wall 57 so that a mixing chamber 58 is formed, but said mixing chamber 58 communicates with the main chamber 55 in the region of the outlet opening 53. A gear oil radiator 59 with two gear oil ports 59*a*, 59*b* which lead outward is arranged in the mixing chamber 58. A mixing thermostat 60, which has a fluid connection to the secondary chamber 56 by means of an inlet 60*a*, and to the mixing chamber 58 by means of an outlet 60*b*, is integrated into the mixing chamber 58 in the region of the secondary chamber 56. A second inlet 60*c* of the mixing thermostat 60 can be connected to the coolant circuit described above. The thermostat cartridge 60 is sealed against the receptacle in the collecting box by means of seals. In one exemplary embodiment, the longitudinal dividing wall 57 may be an integral component of the collecting box 52 or constitute an additional component. In order to simplify the manufacture of the collecting box 52, it is advantageous to attach the longitudinal dividing wall 57 to the gear oil radiator 59. The longitudinal dividing wall 57 is then to be configured in such a way that when the gear oil radiator 59 is mounted it is sealed into the collecting box 52. For this purpose, corresponding sealing faces are to be provided in the collecting box 52 and on the longitudinal dividing wall 57. A seal is also possibly to be provided or there is to be provision for the dividing wall to be embodied as a hard/soft part with a sealing lip which is attached by injection molding.

Owing to the dividing wall 54 which is arranged in the outlet-end collecting box 52, the main region 50*a* and the low-temperature region 50*b* of the radiator 50 have parallel flows through them, i.e. a main stream of coolant forms, which flows out into the main chamber 55 and leaves the radiator 50 via the outlet 53, and a partial stream forms, which flows out into the secondary chamber 56 and enters the mixing chamber 58 via the outlet 60*b* of the mixing thermostat 60. Coolant is added, if required, to this partial stream of coolant via the further inlet 60*c*. The coolant which has passed into the mixing chamber 58 flows through the gear oil radiator 59 and is then added to the main stream in the region of the outlet opening 53.

The main stream and the partial stream are dimensioned in such a way that the partial stream of coolant through the low-temperature part 50*b* makes up approximately 4% to 15% of the entire stream of coolant which enters the radiator 50 through the coolant inlet 52. The size of the low-temperature part 50*b* is advantageously dimensioned in such a way that the end face of the low-temperature part 50*b* makes up between 10% and 40% of the end face of the radiator 50. Between these percentages, in the range from 20% to 30% surface area, there is a preferred range. The coolant radiator 50 is preferably installed in the motor vehicle as a cross stream radiator, i.e. with horizontally extending pipes (not illustrated). In this context the low-temperature part 50*b* can lie at the top or at the bottom, which depends on the stream of cooling air in the vehicle. For example, further heat exchangers, for example charge air radiators, which heat up the cooling air, may be connected upstream in the lower region of the coolant radiator. An arrangement in the upper region would then be advantageous for the purpose of better cooling of the low-temperature range 50*b*. As already mentioned, owing to the relatively low temperature differences, the main region 50*a* and the low-temperature region 50*b* may be manufactured in one pipe/rib block with common pipe bases and collecting boxes. However, it may also be advantageous to form the main chamber 55 and the secondary chamber 56 as separate chambers or to separate both cooling regions 50*a* and 50*b* completely, i.e. into a separate main radiator and a separate low-temperature radiator, to which coolant is applied in parallel. There may also be two or more streams flowing through the low-temperature part 50*b*, for example by deflecting the coolant at depth, i.e. in the direction of the flow of cooling air. As a result, the coolant temperature is reduced further. The low-temperature part can also be formed from one part region of the radiator and additionally by a separate component. The partial stream of coolant may flow in parallel or successively through the two segments of the low-temperature part which are produced in this configuration. The segment of the low-temperature part which constitutes a separate component may be arranged in the cooling air stream upstream of the radiator unit which contains the other segment of the low-temperature part. If the partial stream of coolant flows successively through the two segments, a similarly high thermodynamic effectiveness of the low-temperature part to when the coolant is deflected at depth is produced.

One advantage of the configuration of the low-temperature part as a separate unit or with a segment of the low-temperature part as a separate unit is the reduced alternating temperature stress.

The main part of the radiator may have a single stream through it or have a deflection.

FIG. 6 shows a further exemplary embodiment of a coolant radiator 61 which is of similar design to the coolant radiator 50 according to FIG. 5, specifically with a main cooling region 61*a* and a low-temperature region 61*b*, which regions 61*a* and 61*b* each communicate with an inlet box 62 with a coolant inlet opening 63 and an outlet box 64 with an outlet opening 65. A dividing wall 66 is arranged in the outlet box 64 and divides it into a main chamber 67 and a secondary chamber 68. The main region 61*a* and the partial region 61*b* thus have parallel streams of coolant. The secondary chamber 68 is adjoined by a mixing chamber 69 into which a mixing thermostat 70 is inserted, said mixing thermostat 70 communicating both with the secondary chamber 68 and with the mixing chamber 69 at the output end and with the cooling circuit (not illustrated here) at the input end. A mounting plate 71, by means of which a gear oil radiator 72 is attached to the coolant radiator 61 and is connected on the coolant side to the mixing chamber 69 and to the main chamber 67, specifically via a coolant inlet duct 73 and a coolant outlet duct 74, is arranged on the outside of the outlet-end collecting box 64. The gear oil circuit (not illustrated) is connected via the connectors 72*a*, 72*b*. In contrast to the gear oil radiator 59 according to FIG. 5, this gear oil radiator 72 has a separate housing for conducting the coolant. The housing is embodied in the form of a flange on its attachment side, is clamped to the mounting plate 71 and sealed with respect to the mounting plate 71 by means of a sealing plate 73. Conventional coolant inlet and outlet connectors can thus be dispensed with. The mounting plate 71 is advantageously integrally formed on the collecting box 64 and contains the two coolant ducts 73, 74. However, feeding the partial stream of coolant back via the outlet duct 74 is recommended only for an arrangement of the main thermostat in the section located upstream of the radiator.

The gear oil radiator may be attached to the water box, to the fan cowling or to the module frame with or without a mounting plate. Other mounting locations on the cooling module or on the other side from the cooling module are also possible.

The gear oil radiator may be embodied with or without a separate housing for conducting the coolant. In the embodiment with a housing for conducting the coolant, respective inlet and outlet connectors may be provided for the coolant and gear oil. When the radiator is used with a mounting plate the coolant-side connector may be dispensed with entirely or partially.

The mixing thermostat may be integrated into the mounting plate or built on directly to the gear oil radiator. Other possible configuration are obtained by arranging the mixing thermostat in the coolant guides, with the possibility of the mixing thermostat being additionally attached at the radiator, at the fan cowling, at the module frame or at some other location. The opening thermostat may be integrated into the mounting plate or built on directly to the gear oil radiator. Further configuration possibility are obtained by arranging the opening thermostat in the coolant guides, with the possibility of the opening thermostat being additionally attached at the radiator, at the fan cowling, at the module frame or at another location. Furthermore it is possible to integrate the opening thermostat into the water box. In this case, the configuration possibilities correspond to those when the mixing thermostat is integrated into the water box.

The invention claimed is:

1. A cooling circuit of an internal combustion engine of a motor vehicle having a main cooling circuit, comprising:

a main radiator (5*a*), a section (3) located upstream of the radiator, a radiator return flow section (8), a coolant pump (10), a main thermostat (2) and a bypass or short circuit (4) between the main thermostat (2) and the coolant pump (10), and a low-temperature circuit, comprising a low-temperature radiator (5*b*), a low-temperature radiator return flow section (11), a valve unit, and an additional heat exchanger, wherein the low-temperature radiator (5*b*) is connected in parallel with the main radiator (5*a*);

wherein the main thermostat (2) is arranged in the section (3) located upstream of the radiator; and wherein the valve unit is embodied as a mixing thermostat (14) with a first inlet, a second inlet, and one outlet, wherein the first inlet and the outlet are connected into the return flow section (11) of the low-temperature radiator (5*b*), and the second inlet is connected to the main thermostat (2).

2. The cooling circuit as claimed in claim 1, wherein the additional heat exchanger is embodied as a gear oil radiator (13).

3. The cooling circuit as claimed in claim 1, wherein a warming up thermostat (16) is connected between the second inlet and the main thermostat (2).

4. A cooling circuit of an internal combustion engine of a motor vehicle having a main cooling circuit, comprising:

a main radiator (5*a*), a section (3) located upstream of the radiator, a radiator return flow section (8), a coolant pump (10), a main thermostat (2) and a bypass or short circuit (4) between the main thermostat (2) and the coolant pump (10), and a low-temperature circuit, comprising a low-temperature radiator (5*b*), a low-temperature radiator return flow section (11), a valve unit, and an additional heat exchanger, wherein the low-temperature radiator (5*b*) is connected in parallel with the main radiator (5*a*);

wherein the main thermostat (2) is arranged in the section (3) located upstream of the radiator; and wherein the valve unit is embodied as a warming up thermostat (16) which is connected between the return flow section (11) of the low-temperature radiator (5*b*) and the bypass or short circuit (4).

5. A cooling circuit of an internal combustion engine of a motor vehicle having a main cooling circuit, comprising:

a main radiator (5*a*), a section (3) located upstream of the radiator, a radiator return flow section (8), a coolant pump (10), a main thermostat (2) and a bypass or short circuit (4) between the main thermostat (2) and the coolant pump (10), and a low-temperature circuit, comprising a low-temperature radiator (5*b*), a low-temperature radiator return flow section (11), a valve unit, and an additional heat exchanger, wherein the low-temperature radiator (5*b*) is connected in parallel with the main radiator (5*a*);

wherein the main thermostat (2) is arranged in the radiator return flow section (8); and wherein the valve unit is embodied as a mixing thermostat (4) with a first inlet, a second inlet, and one outlet, wherein the first inlet and the outlet are connected into the return flow section (11) of the low-temperature radiator (5*b*), and the second input is connected to the section (3) located upstream of the radiator.

6. The cooling circuit as claimed in claim 5, wherein a warming up thermostat (16) is connected between the section (3) located upstream of the radiator and the second inlet.

7. A cooling circuit of an internal combustion engine of a motor vehicle having a main cooling circuit, comprising:

a main radiator (5*a*), a section (3) located upstream of the radiator, a radiator return flow section (8), a coolant pump (10), a main thermostat (2) and a bypass or short circuit (4) between the main thermostat (2) and the coolant pump (10), and a low-temperature circuit, comprising a low-temperature radiator (5*b*), a low-temperature radiator return flow section (11), a valve unit and an additional heat exchanger, wherein the low-temperature radiator (5*b*) is connected in parallel with the main radiator (5*a*);

wherein the main thermostat (2) is arranged in the radiator return flow section (8); and wherein the valve unit is embodied as a warming up thermostat (16) which is connected into the return flow section (11) of the low-temperature radiator (5*b*).

8. A coolant radiator of a cooling circuit of an internal combustion engine of a motor vehicle, comprising:

a pipe/rib block, a coolant inlet box (51, 62) with a coolant inlet (53, 63), and a collecting box (52, 64) with a coolant connection to the pipe/rib block, wherein the pipe/rib block has a main region (50*a*, 61*a*) and a low-temperature region (50*b*, 61*b*), and coolant outlets for a coolant main flow and a coolant partial flow;

wherein the main region (50*a*, 61*b*) and the low-temperature region (50*b*, 61*b*) are connected in parallel; and wherein a dividing element (54, 66) which divides the pipe/rib block into the main region (50*a*, 61*a*) and the low-temperature region (50*b*, 61*b*), and divides the collecting box (52, 64) into a main chamber (55, 67) and a secondary chamber (56, 68) is arranged in the collecting box (52, 64).

9. The coolant radiator as claimed in claim 8, wherein the dividing element is embodied as a sealed dividing wall (54, 66).

10. The coolant radiator as claimed in claim 8, wherein the dividing element is embodied as an unsealed dividing wall with a throttle point.

11. The coolant radiator as claimed in claim 8, wherein the dividing element is embodied as a dividing wall with a valve.

12. The coolant radiator as claimed in claim 8, wherein an additional heat exchanger is integrated into, or with, the collecting box (52, 64), and a partial stream of coolant can flow through it.

13. The coolant radiator as claimed in claim 8, wherein an open longitudinal dividing wall (57) is arranged in the main chamber (55) and forms a mixing chamber (58) in which the additional heat exchanger (59) is arranged.

14. The coolant radiator as claimed in claim 13, wherein a mixing thermostat (60), which has a coolant connection to the secondary chamber (56) and the mixing chamber (58) and can be connected to the cooling circuit, is integrated into the mixing chamber (58).

15. The coolant radiator as claimed in claim 12, wherein the additional heat exchanger (72) is attached to the collecting box (64) by a mounting plate (71).

16. The coolant radiator as claimed in claim 15, wherein a mixing chamber (69) is arranged in the region of the secondary chamber (68) and a mixing thermostat (70), wherein the mixing thermostat has a coolant connection to the secondary chamber (68) and to the mixing chamber (69) and can be connected to the cooling circuit is integrated into the mixing chamber (69), and wherein the additional heat exchanger (72) has a coolant connection to the mixing chamber (69) and the main chamber (67).

17. The coolant radiator as claimed in claim 12, wherein the additional heat exchanger is a gear oil radiator (59, 72).

18. A coolant radiator of a cooling circuit of an internal combustion engine of a motor vehicle, comprising:

a pipe/rib block, a coolant inlet box (51, 62) with a coolant inlet (53, 63), and a collecting box (52, 64) with a coolant connection to the pipe/rib block, wherein the pipe/rib block has a main region (50*a*, 61*a*) and a low-temperature region (50*b*, 61*b*) and coolant outlets for a coolant main flow and a coolant partial flow;

wherein the main region (50*a*, 61*b*) and the low-temperature region (50*b*, 61*a*) are connected in parallel; and wherein a partial stream of coolant, which makes up approximately 4% to 15% of an entire stream of coolant, can flow through the low-temperature region (50*b*, 61*b*).

* * * * *